United States Patent [19]

Amengual

[11] 4,155,381

[45] May 22, 1979

[54] WEFT THREAD MONITORING DEVICE

[75] Inventor: Juan Amengual, Paseo Maritimo 20, Palma de Mallorca, Spain

[73] Assignees: AB IRO, Ulricehamn, Sweden; Juan Amengual, Palma de Mallorca, Spain

[21] Appl. No.: 874,686

[22] Filed: Feb. 2, 1978

[30] Foreign Application Priority Data

Feb. 4, 1977 [DE] Fed. Rep. of Germany ..... 2704731

[51] Int. Cl.[2] ..... D03D 51/34

[52] U.S. Cl. ..... 139/370.1

[58] Field of Search ..... 139/370.1, 370.2, 374, 139/375; 66/163

[56] References Cited

U.S. PATENT DOCUMENTS

| | | | |
|---|---|---|---|
| 2,819,737 | 1/1958 | Opl et al. | 139/370.1 |
| 3,145,739 | 8/1964 | Metzler | 139/370.1 |
| 3,570,551 | 3/1971 | Deborde | 139/370.2 |
| 4,009,737 | 3/1977 | Rouhr et al. | 139/370.2 |
| 4,063,575 | 12/1977 | Santi | 139/370.2 |

*Primary Examiner*—Henry Jaudon

*Attorney, Agent, or Firm*—James E. Nilles

[57] ABSTRACT

A weft thread monitoring device comprises a carrier element, such as a push rod, that is moved in one direction relative to the loom frame by beating-up motion of the reed and is biased in an opposite return direction. A feeler that is carried for bodily motion by the carrier element and is movable relative to it has a sensing arm that is engaged by a weft thread during beat-up and a controlled arm cooperable with an actuator for a cut-off switch. The feeler is biased relative to the carrier element towards an actuating position in which its controlled arm can engage the actuator during return motion of the carrier element and move the actuator to stop the loom. However, if the sensing arm is held captive by a properly laid and beaten-up weft thread, the feeler is maintained, against its bias, in a position in which the controlled arm clears the actuator during carrier element return motion, and at the conclusion of such return motion the sensing arm is snapped out of engagement with the weft thread.

8 Claims, 3 Drawing Figures

WEFT THREAD MONITORING DEVICE

This invention relates to apparatus for monitoring the weft thread in a loom, whereby the loom is stopped in the event of breakage or insufficient tensioning of the weft thread; and the invention is more particularly concerned with a weft thread monitoring device which does not impose any force upon the weft thread until the weft thread has been brought to its appointed position in the weave by the beating action of the reed and has been locked into that position by a change in the shedding of the warp threads.

In looms in which the respective fed-in weft threads are held and stretched at both sides of the fabric by means of weft thread grippers, it is known to provide monitoring devices which signal both the failure of a weft thread to arrive and insufficient lengthwise tension on a weft thread such as may be due to its breaking. A known monitoring device of this type comprises a bifurcated rider that bears with a predetermined force upon a weft thread held between the weft thread grippers. When the weft thread is freed from one of the grippers, or breaks between the grippers, the rider thus loses its support, and as it gives way it activates a switch that turns off the loom so that the fault can be corrected.

In looms with spindleless shuttles or gripper shuttles, free ends result from the cutting off of the weft threads, so that every weft thread lies in the woven material without lengthwise tension. U.S. Pat. No. 3,494,384 discloses a gripper shuttle loom wherein every weft thread is transported to about the middle of the fabric in a U-shaped loop, is then cut off at one selvedge of the fabric and has its free end led out by the gripper shuttle to the other selvedge. A bifurcated rider such as was previously customary cannot be employed for monitoring the weft thread in such a loom because the weft thread, due to its lack of support and lengthwise tension, cannot resist the sensing force of the rider. Thus, in a gripper shuttle loom, a fault impulse would be produced even by a correctly fed and beaten-in weft thread with free ends, because it would yield under the sensing force of the rider and one part of it would be pulled back in the fabric.

The general object of the present invention is to provide a sturdy and compact weft thread monitoring device that is readily adaptable to existing looms without requiring substantial modification thereof, and is capable of operation even in looms with alternate-sided weft thread feed by means of a gripping shuttle, which monitoring device is capable of detecting an incompletely picked weft thread or a weft thread break and of thereupon switching off the loom.

Thus it is a more specific object of the invention to provide a device for reliably monitoring the untensioned weft thread in a gripper shuttle loom, which device is particularly capable of promptly detecting excessively short free ends (short picks) of a weft thread that result from its being incompletely pulled through, or from its being cut off at the wrong time at one selvedge of the fabric.

Another specific object of the invention is to provide a weft thread monitoring device that can act to stop the loom only during return motion of the reed, after the shedding of the warp threads has been changed to lock the weft thread in place, and which therefore cannot produce a false indication, occasioned by yielding of an otherwise satisfactory weft thread in response to force exerted by the monitoring device.

It is also an object of the invention to provide a weft thread monitoring device that operates with high functional security for all weft-thread faults, including those due to absence of a weft thread and those due to an insufficiently supported weft thread.

It is also a specific object of this invention to provide a weft thread monitoring device of the character described that comprises a movable feeler having very small mass and therefore having relatively small inertia so as to be capable of very rapid responses, to thus be very suitable for high speed weaving operations.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which.

Figure 1:
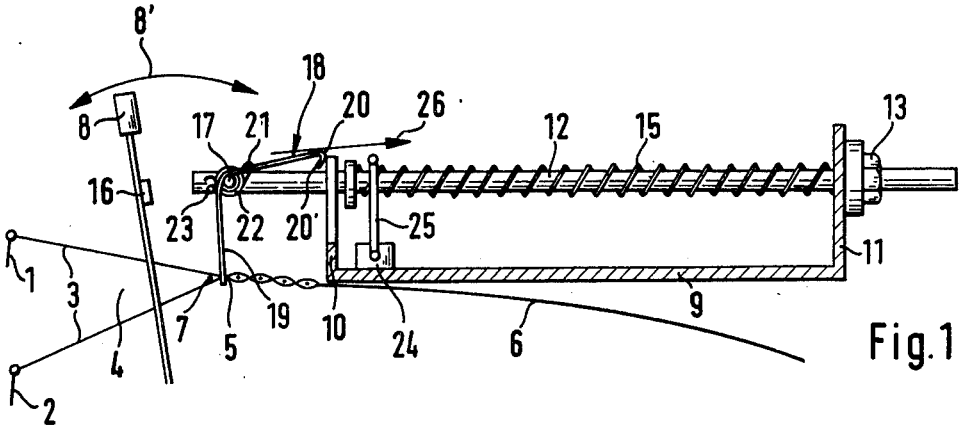
FIG. 1 is a more or less diagrammatic view in side elevation of a weft thread monitoring device embodying the principles of this invention, shown in an initial position, immediately after the picking of a weft thread.

Referring now to the accompanying drawings, FIG. 1 illustrates only the portions of a loom that are essential to an understanding of the invention, together with a fell portion of the fabric already woven in the loom and the front portion of the warp threads continuous with that fabric. As is conventional, heddles 1 and 2 manipulate the warp threads 3 in such a manner as to form an alternating shed 4, the front end of which is defined by the fell 5. Extending forwardly from the fell 5 is the finished portion 6 of the fabric which, as the weaving progresses, is guided forwardly and rolled up by apparatus that is well known and therefore not illustrated.

A weft thread 7 is carried through the shed 4, as by means of a gripping shuttle (not shown), to extend transversely to the direction of the warp threads 3. A reed 8, driven for movement in the forward and rearward directions denoted by the two-headed arrow 8', beats up the weft thread 7 against the fell 5 in its forward motion. After each beating-up motion of the reed 8, the shed 4 is reversed in a known manner so that the newly placed weft thread is held securely in place and is separated from the next following weft thread by the crossed-over warp threads.

A substantially U-shaped bracket 9 is mounted on the frame of the loom or on a shearing box (not shown) on the frame. The upright rear and front arms 10 and 11, respectively, of the bracket guidingly support a push rod 12 that is longitudinally movable in directions approximately parallel to the stretch of fabric 6. An abutment 13 on the front end portion of the push rod cooperates with the outer surface of the front bracket arm 11 to define a limit of rearward motion of the push rod, that is, to limit push rod motion in the direction opposite to that of beating motion of the reed 8. The push rod is urged towards that rearward limit of its motion (towards the left in FIG. 1) by means of a coiled expansion spring 15 that surrounds the push rod and reacts between the inner surface of the front bracket arm 11 and a spring seat 14 that is fixed on the push rod between the bracket arms. However, during forward beating-up motion of the reed 8, an abutment 16 on the reed engages the rear end of the push rod and moves the push rod longitudinally forwardly against the bias of the spring 15.

Extending transversely through the rear end portion of the push rod is a pin 17 that serves as a pivot bearing for a feeler 18. The feeler 18 is formed as a bell crank or two-armed lever, comprising a lower arm 19 which extends downwardly between warp threads 3 and an upper arm 20 that extends forwardly and is substantially hook shaped to have a camming nose 20' at its free end. The two feeler arms 19 and 20, which are disposed at an angle of about 90° to one another, are connected by means of an integral loop that defines an eye 21 surrounding the pin 17, so that the feeler 18 is swingable about the axis of the pin 17. The pin 17 also supports a coiled torsion spring 22 that has one end connected with an arm of the feeler 18 and has its other end reacting against a suitable abutment 23 which is so arranged that the spring 22 biases the feeler for rotation about the pin 17 in the clockwise direction as shown in FIG. 1. The abutment 23 against which the torsion spring 22 reacts can comprise a part of the push rod 12 that is adjacent to the pin 17, or it can be formed on the pin 17 itself if that pin is confined against rotation.

The upper arm 20 of the feeler 18 is arranged for cooperation with an actuating link 25 of a cut-off switch 24 by which the loom mechanism can be stopped in a known manner upon the occurrence of a weft thread failure. The switch 24, and particularly its actuating link 25, can be located between the arms 10 and 11 of the bracket 9, nearer the rear arm 10. The upwardly projecting actuating link 25 is so arranged in relation to the switch 24 that the loom is stopped when that link is swung rearwardly (to the left).

The hook-shaped end portion 20' of the upper arm 20 of the feeler is so configured that it can cam itself up and over the actuating link 25 during bodily forward motion of the feeler; but upon rearward motion of the feeler (to the left) the hook portion 20' of the feeler is either in a raised position, so that it passes above the actuating link 25, leaving it undisturbed, or is in a lowered operative position in which it hookingly engages that actuating link and swings it to the left to stop the loom. Whether the hooked feeler arm 20 clears the actuating link 25 or actuates it depends upon the condition of the weft thread that is beaten into position by the reed 8. If that weft thread is properly laid and tensioned, then it cooperates with the lower arm 19 of the feeler to maintain the upper arm 20 in its raised position as the reed 8 and the push rod 12 move in their rearward return strokes. But if the weft thread is in any wise faulty, the feeler can swing about the pivot pin 17 in response to its torsion spring 22, so that the upper arm 20 remains in its lowered operative position during the concurrent return strokes of the reed 8 and the push rod 12, in which position the arm 20 of course swings the actuator link 25 to stop the loom.

The arrangement of the feeler 18 in relation to the switch actuating link 25 and the push rod 12 will be more fully understood from the following description of the operation of the mechanism.

In the condition of the apparatus that is illustrated in FIG. 1, the reed 8 is beginning its motion to beat up a correctly placed weft thread against the fell 5, and the abutment 16 that is carried by the reed is moving towards actuating engagement with the rear end of the push rod 12. The feeler 18 is in the position of its swinging motion to which it is biased by its spring 22.

Figure 2:
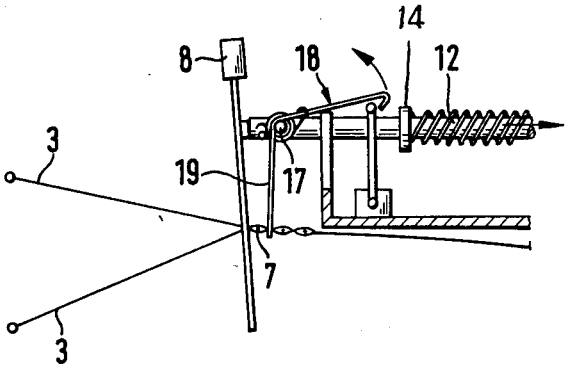
FIG. 2 is a view generally similar to FIG. 1 but showing only a portion of the apparatus depicted in FIG. 1, in its condition during the beating-up motion of the reed.

FIG. 2 shows the reed 8 at the conclusion of its beating stroke, by which it drives the weft thread 7 to its appointed place in the fabric and by which the push rod 12 is displaced forwardly (to the right) against the bias of its spring 15. Such motion of the push rod carries the hook portion 20' of the upper feeler arm across the top of the actuating link 25, and, owing to the camming surface provided by that hook portion, the feeler arm 20 snaps over the actuating link to have its hook portion disposed slightly to the right of the link at the conclusion of the beating stroke of the reed. While the reed 8 is in its farthest forward position, the shed 4 of the warp threads 3 is changed, and the weft thread is thereby clamped along its length by the crossing warp threads.

Figure 3:
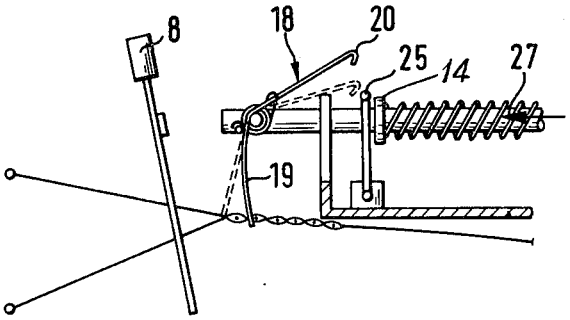
FIG. 3 is a view similar to FIG. 2 but showing the apparatus in its condition after beating of a properly installed weft thread.

As soon as the reed 8 begins its return movement (to the left), the push rod 12 moves rearwardly with it, under the biasing force of its spring 15; and the feeler 18, carried by the pin 17, moves bodily with the push rod. Assuming that the weft thread has been properly laid and tensioned, the tip portion of the lower arm 19 of the feeler 18 is held captive by the weft thread (see FIG. 3) during most of the rearward motion of the push rod, and hence the motion of the push rod, and particularly of the pin 17, causes the feeler to rotate counterclockwise, against the bias of its torsion spring 22. Such feeler rotation of course raises the free end portion of the upper feeler arm 20, so that it passes above the top of the actuating link 25 as the push rod moves rearwardly with the reed. Finally, just before the push rod reaches its rearmost position, defined by the engagement of its abutment 13 with the bracket arm 11, and after the hook portion of the upper feeler arm 20 has passed the actuating link 25, the rearward bodily movement of the feeler carries the tip portion of its lower arm 19 out of engagement with the weft thread that has held it captive. Such release occurs with an abrupt snap action, since immediately upon release of the lower arm 19 the torsion spring 22 rotates the feeler clockwise to its lowered position in which the hooked arm 20 lies in its normal motion path, which is denoted by arrow 26 in FIG. 1 and in which the feeler can cooperate with a new weft thread in the same manner as just described.

In the event a weft thread is not properly installed and therefore does not engage the lower leg 19 of the feeler, or engages that leg under too little tension, the hook portion of the feeler arm 20 is maintained by the torsion spring 22 in its lowered operative position during the return (leftward) stroke of the push rod 12, and its hook portion 20' then engages the actuating link 25 and swings it to the left to effect stopping of the loom. The cause of the improperly picked weft thread can then be determined and corrected.

It will be observed that the rear bracket arm 10 serves as a stop against which the upper feeler arm 20 can engage under the biasing force of the torsion spring 22. Swinging motion of the feeler in the direction of its bias is thus limited, so that the lower arm 19 of the feeler is in a position to be engaged by a weft thread during beating motion of the reed 8, while the upper feeler arm tends to be maintained in a ready position in which it is substantially aligned with the actuating link 25.

Since feeler motion must be fast enough for the feeler to remain in step with all other movements of the loom mechanism, it is desirable that the upward swinging motion of the upper feeler arm 20 be so limited that said arm just clears the actuator 25 when moving in its raised position and has its hook portion only slightly beyond the actuator 25 when the push rod 12 is at its forward limit of travel. To some extent these requirements are met by making the upper feeler arm 20 as short as possible consistent with dependable operation; but it is also necessary that the stroke of the push rod 12 be adjustable to accommodate the length of the particular arm 20 and the amount of lift that it requires, and also to accommodate differences in mesh size and the vigor of beating movement of the reed 8. To that end the abutment 13 on the push rod is adjustable axially along it and can thus comprise a lock nut for which the front end portion of the push rod is threaded. With proper design of the upper feeler arm 20 and proper adjustment of the abutment 13, the push rod can move with the reed 8 during only a small portion of its stroke. Small dimensions of the feeler and a short stroke of the push rod 12 further assure low mechanical wear and quiet operation.

It will be apparent that the feeler could be gravity biased by means of a suitable weight, instead of being biased by the torsion spring 22 or its equivalent, or could be biased by hydraulic or pneumatic means.

Because the feeler arms 19 and 20 are disposed substantially at right angles to one another, and the lower arm 19 extends substantially perpendicular to the plane of the fabric, the switch 24 and its actuator 25 can be arranged at a small distance from the path of the fabric and the feeler arms provide a favorable lever action during feeler actuation, assuring positive switch actuation or positive clearance of the actuator by the feeler arm 20, as circumstances require.

Making the feeler 18 of spring steel wire assures that it will have low inertia forces and will therefore be able to move rapidly from one to another of its positions, as is necessary during high speed weaving operations. Such construction of the feeler also enables its lower arm 19 to have substantial resilience, so that for all practical purposes it can undergo only elastic deformation as a result of actuation due to weft thread engagement, and the feeler thus has a long useful life. A further advantage is apparent from the fact that the spring steel wire of which the feeler is formed need not be more than a few tenths of a millimeter in diameter, so that the lower feeler arm 19 can readily fit between warp threads of even a fine mesh fabric, to thus avoid erroneous switching by reason of the lower arm being hung up on warp threads. The light weight of a feeler made of spring steel wire allows it to be biased by a light biasing force (e.g., soft and weak spring 22) so that the actuating forces required to overcome that bias are correspondingly small and the feeler can therefore cooperate satisfactorily with very light and weak weft threads.

For a very sturdy operation, where higher operating forces can be accommodated and there is a larger amount of space between warp threads, the feeler can be formed as a leaf spring.

When the weft threads are repectively fed from a position at alternate sides of the loom and are guided by their free ends around the opposite selvedges, it is desirable to provide a feeler adjacent to each selvedge, within the width of the fabric. In some cases it may be desirable to arrange a multiplicity of feelers at intervals across the width of the fabric, for dependable detection of weft thread breakages that might occur anywhere across the width of the fabric, having in mind that feelers located close to the selvedges might not detect a weft thread breakage at the middle of the fabric owing to the outer portions of the broken weft thread being adequately supported by crossing warp threads.

It will be obvious that the invention is not limited to the particular illustrative embodiment herein shown and described. For example, it will be evident that instead of a swingable feeler, a lengthwise movable pressure feeler could be employed. Similarly, the cutoff switch for the loom can be actuatable in any suitable manner. For example, in a practical embodiment the switch could be arranged as a rotary switch directly in the zone of the pivot bearing pin, or could take the place of that pin and be actuated by the swinging motion of the feeler.

From the foregoing description and the accompanying drawings it will be apparent that this invention provides a device for monitoring a weft thread that comprises simple, efficient and economical means cooperating with the parts of a loom that effect the weaving operation, whereby assurance is had that any fault or failure in the picking or beating up of a weft thread, or in a weft thread itself, will be detected and will cause the loom to be shut down.

Those skilled in the art will appreciate that the invention can be embodied in forms other than as herein disclosed for purposes of illustration.

The invention is defined by the following claims.

I claim:

1. In a loom having a reed that moves through a stroke in a forward direction for beating up a weft thread and in the opposite rearward direction after changing of the warp thread shed, weft thread monitoring means for causing a cut-off device to stop operation of the loom in response to a weft thread fault, said monitoring device comprising:

A. a carrier element movably mounted on a relatively stationary part of the loom that is in front of the stroke of the reed and spaced from the plane in which weft threads move when beaten up by the reed, said carrier element being constrained to motion relative to said stationary part in substantially said forward and rearward directions;

B. biasing means urging said carrier element rearwardly to a defined normal position;

C. cooperating connection means on the reed and on said carrier element for constraining the carrier element to move forwardly during at least the final part of forward beating-up movement of the reed and permitting the carrier element to return to its normal position upon rearward movement of the reed;

D. a sensing arm carried by the carrier element for bodily forward and rearward motion therewith, said sensing arm being swingable forwardly and rearwardly relative to the carrier arm, to and from a defined rearward position to which the sensing arm is biased and in which a free end portion thereof projects across said plane to be captivated by a properly placed and beaten-up weft thread, said portion of the sensing arm being releasable from such captivation upon rearward motion of the carrier element and consequent forward swinging of the sensing arm relative to the carrier element;

E. a controlled member carried by the carrier element for bodily motion therewith in said forward and rearward directions and movable relative to the carrier element transversely to those directions toward and from a defined operative position, said controlled member
(1) being biased to its operative position and
(2) having a connection with the sensing arm whereby the controlled member is moved out of its operative position by forward swinging of the sensing arm relative to the carrier element;

F. an actuator operatively associated with said cut-off device and having a portion which is in the path of bodily movement of said controlled member when the same is in its operative position, said actuator being movable rearwardly from a normal position in which the loom can operate to a cut-off position at which operation of the loom is stopped;

G. cooperating cam means on said portion of the actuator and on the controlled member, engageable upon forward bodily motion of the controlled member to cam the same away from its operative position so that it can pass the actuator; and H. cooperating abutment means on said portion of the actuator and on the controlled member, engageable upon rearward bodily motion of the controlled member when the same is in its operative position and whereby the force of said biasing means is imposed upon the actuator through the controlled member to move the actuator to its cut-off position.

2. The weft thread monitoring means of claim 1, further characterized by:
(1) said carrier element comprising a lengthwise slidable push rod, and
(2) said biasing means comprising a coiled spring which surrounds the push rod and reacts between the push rod and said relatively stationary part of the loom.

3. The weft thread monitoring means of claim 2, further characterized by:
said cooperating connection means on the reed and on the carrier element comprising an abutment carried by the reed and engageable with one end of the push rod.

4. The weft thread monitoring means of claim 1 wherein said controlled member comprises one arm of a two-armed lever, the other arm of which comprises said sensing arm, further characterized by:
(1) said one arm comprising said controlled member being disposed substantially at right angles to said sensing arm and projecting substantially forwardly therefrom, and
(2) said two-armed lever being pivoted to the carrier element between its said arms for swinging motion about an axis which is transverse to said forward and rearward directions and parallel to said plane in which weft threads move when beaten-up by the reed.

5. The weft thread monitoring means of claim 4, further characterized by:
(3) said carrier element comprising a lengthwise slidable push rod, and
(4) said lever being pivoted to the push rod by means of a pin extending transversely through the push rod.

6. The weft thread monitoring means of claim 5 wherein said two-armed lever is formed from a single length of spring wire with its arms connected by a loop that surrounds said pin to swingably mount the lever thereon.

7. The weft thread monitoring means of claim 6 wherein the arm of said length of spring wire that comprises said controlled member has its front end portion formed as a hook which opens rearwardly and which comprises said cam means and said abutment means on the controlled member.

8. The weft thread monitoring means of claim 5, further characterized by:
(5) abutment means on said push rod, adjustable along the length thereof and cooperable with said stationary part of the loom to define said normal position of the carrier element.

* * * * *